US007614698B2

(12) United States Patent
Maier

(10) Patent No.: US 7,614,698 B2
(45) Date of Patent: Nov. 10, 2009

(54) CHAIR WITH TILTING SEAT

(75) Inventor: Peter Maier, Herrischried (DE)

(73) Assignee: Sedus Stoll Aktiengesellschaft, Waldshut (DE)

( * ) Notice: Subject to any disclaimer, the term of this patent is extended or adjusted under 35 U.S.C. 154(b) by 10 days.

(21) Appl. No.: 11/975,171

(22) Filed: Oct. 18, 2007

(65) Prior Publication Data

US 2008/0093904 A1 Apr. 24, 2008

(30) Foreign Application Priority Data

Oct. 18, 2006 (DE) ..... 10 2006 049 676

(51) Int. Cl.
*A47C 1/00* (2006.01)

(52) U.S. Cl. ..... 297/313

(58) Field of Classification Search ..... 297/313, 297/337, 463.1, 463.2; 74/527, 526, 528, 74/502.2, 489, 558.2

See application file for complete search history.

(56) References Cited

U.S. PATENT DOCUMENTS 2,025,436 A * 12/1935 Brosset ..... 297/326
2,310,346 A * 2/1943 Bell ..... 248/408
4,235,471 A * 11/1980 Tengler ..... 297/364
4,471,994 A * 9/1984 Zund et al. ..... 297/300.3
4,503,877 A * 3/1985 Ward et al. ..... 137/119.03
4,834,454 A * 5/1989 Dicks ..... 297/317
4,986,601 A * 1/1991 Inoue ..... 297/300.4
5,301,570 A * 4/1994 Li ..... 74/551.1
5,689,999 A * 11/1997 Wiley et al. ..... 74/527
6,174,031 B1 * 1/2001 Lindgren et al. ..... 297/463.1
6,186,572 B1 * 2/2001 Oh ..... 296/65.05
6,334,651 B1 * 1/2002 Duan et al. ..... 297/284.4
6,402,239 B1 * 6/2002 Haglund ..... 297/216.13
6,431,649 B1 * 8/2002 Hensel ..... 297/300.2
6,439,661 B1 * 8/2002 Brauning ..... 297/300.2

(Continued)

FOREIGN PATENT DOCUMENTS

DE 297 18 651 2/1998

(Continued)

*Primary Examiner*—David Dunn
*Assistant Examiner*—James Alex
(74) *Attorney, Agent, or Firm*—D. Peter Hochberg; Sean F. Mellino; Daniel J. Smola

(57) ABSTRACT

A chair with a tilting seat and a back piece carried by a back support, wherein a bearing block is provided, in which an eccentric cam can rotate, a rod passes eccentrically through the eccentric cam and is connected to it without the ability to rotate, and at one end it is connected to a handle by which it can be turned. An arm is provided in which the rod is mounted such that it can turn. The tilting of the seat can be adjusted in more than just two positions and the adjustments are secured against unintentional change. The bearing block is provided on the back support and the arm on the bottom side of the seat, a detent sleeve is joined to the aforementioned end of the rod, unable to rotate, but able to slide along the rod between a first and a second position. The detent sleeve in the first position engages by detent apparatus fashioned on it with mating detent apparatus on the seat, in the second position, the detent apparatus on the detent sleeve are disengaged from the mating detent apparatus on the seat and spring-loaded against the first position. The handle is joined to the detent sleeve without being able to rotate.

8 Claims, 4 Drawing Sheets

U.S. PATENT DOCUMENTS

| | | | | |
|---|---|---|---|---|
| 6,516,682 | B2 * | 2/2003 | Brainard | 74/502.2 |
| 6,588,844 | B1 * | 7/2003 | Stenzel | 297/300.2 |
| 6,767,061 | B2 * | 7/2004 | Ogino et al. | 297/313 |
| 6,840,578 | B1 * | 1/2005 | Su | 297/302.3 |
| 6,945,605 | B2 * | 9/2005 | Kinoshita et al. | 297/317 |
| 7,147,286 | B2 * | 12/2006 | Cesaroni et al. | 297/301.1 |
| 7,252,627 | B2 * | 8/2007 | Carter | 482/98 |
| 2002/0124679 | A1 * | 9/2002 | Dal Pra | 74/502.2 |
| 2003/0230918 | A1 * | 12/2003 | Serber | 297/313 |
| 2004/0036332 | A1 * | 2/2004 | Voss | 297/313 |
| 2004/0174059 | A1 * | 9/2004 | Elzenbeck | 297/344.1 |
| 2004/0227385 | A1 * | 11/2004 | Piretti | 297/313 |
| 2005/0140194 | A1 * | 6/2005 | Machael et al. | 297/313 |
| 2005/0176559 | A1 * | 8/2005 | Carter | 482/94 |
| 2005/0280301 | A1 * | 12/2005 | Freed et al. | 297/337 |
| 2007/0096524 | A1 * | 5/2007 | Chou | 297/313 |

FOREIGN PATENT DOCUMENTS

| | | |
|---|---|---|
| EP | 0 995 371 | 4/2000 |
| EP | 192 876 | 4/2002 |
| EP | 1192876 | 4/2002 |
| FR | 1 516 753 | 2/1968 |
| WO | WO 97/20706 | 6/1997 |

* cited by examiner

CHAIR WITH TILTING SEAT

CROSS-REFERENCE TO RELATED APPLICATIONS

This application claims foreign priority based on German Patent Application No. 10 2006 049 676.0-14, filed on Oct. 18, 2006, the content of which is incorporated herein by reference in its entirety.

BACKGROUND OF THE INVENTION

1. Field of the Invention

The present invention relates to a chair with a tilting seat and a back piece carried by a back support, wherein a bearing block is provided, in which an eccentric cam can rotate, and a rod passes eccentrically through the eccentric cam and is connected to it without the ability to rotate. At one end the rod is connected to a handle by which it can be turned, and an arm is provided in which the rod is mounted such that it can turn.

2. Description of the Prior Art

A chair of this kind is known from EP 1 192 876 A2. A seat and back support with the back are forcibly coupled in regard to their tilting by a tilting mechanism in this chair. When the back, and with it the back support, is tilted backward, the seat is also lowered. Independently of this, the tilting of the seat relative to the back can be altered in the sense of a presetting and, thus, also when the back is stationary, for example.

This chair works quite well in practice, but the seat tilting can only be changed between two end positions. One such end position is secured by an end stop. To change between the two end positions, one has to overcome a dead center, but this is easy to accomplish. As a result, however, it is also relatively easy for the tilting to change unintentionally.

SUMMARY OF THE INVENTION

It is the problem of the invention to further improve a chair of the aforementioned kind so that the tilting of the seat can be adjusted in more than just two positions and the adjustments are secured against unintentional change. The design of the invention must be rather simple and be easy to make in the production process, and furthermore it must also be quite aesthetically pleasing in appearance.

This problem is solved by the present invention. Accordingly, the invented chair comprises the following features:

- the bearing block is provided on the back support and the arm on the bottom side of the seat;
- a detent sleeve is joined to the aforementioned end of the rod, unable to rotate, but able to slide along the rod between a first and a second position;
- the detent sleeve in the first position engages by a detent apparatus fashioned on it with a mating detent apparatus on the seat;
- in the second position, the detent apparatus on the detent sleeve are disengaged from the mating detent apparatus on the seat and spring-loaded against the first position; and
- the handle is joined to the detent sleeve without being able to rotate.

In the chair of the invention, as compared to the chair already known in the prior art, the bearing block and arm have been interchanged. This has the effect that the distance of the rod from the bottom side of the seat remains constant when the rod is rotated, which in turn makes it possible to lock the rod to the seat in certain positions of rotation. For this, a detent sleeve provided with a detent apparatus is provided on the rod and a mating detent apparatus are provided on the seat, being elastically spring-loaded against each other.

Preferred embodiments of the invention are discussed herein.

BRIEF EXPLANATION OF THE FIGURES

The invention shall now be explained in greater detail by a sample embodiment in conjunction with the drawings.

DETAILED DESCRIPTION OF THE PRESENT INVENTION

Figure 1:
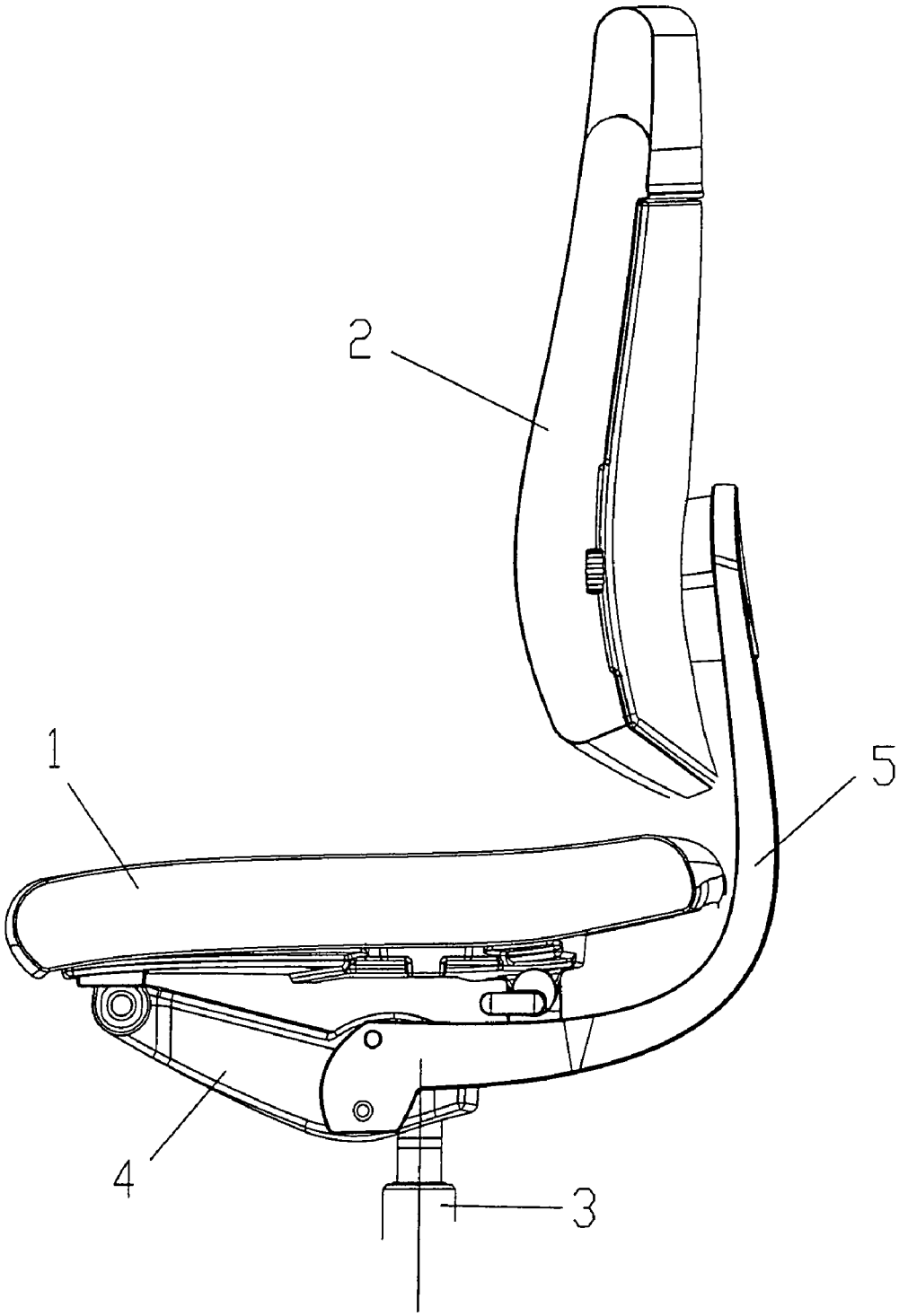
FIG. 1 is a side view of a chair according to the invention with a lowered seat.
Figure 2:
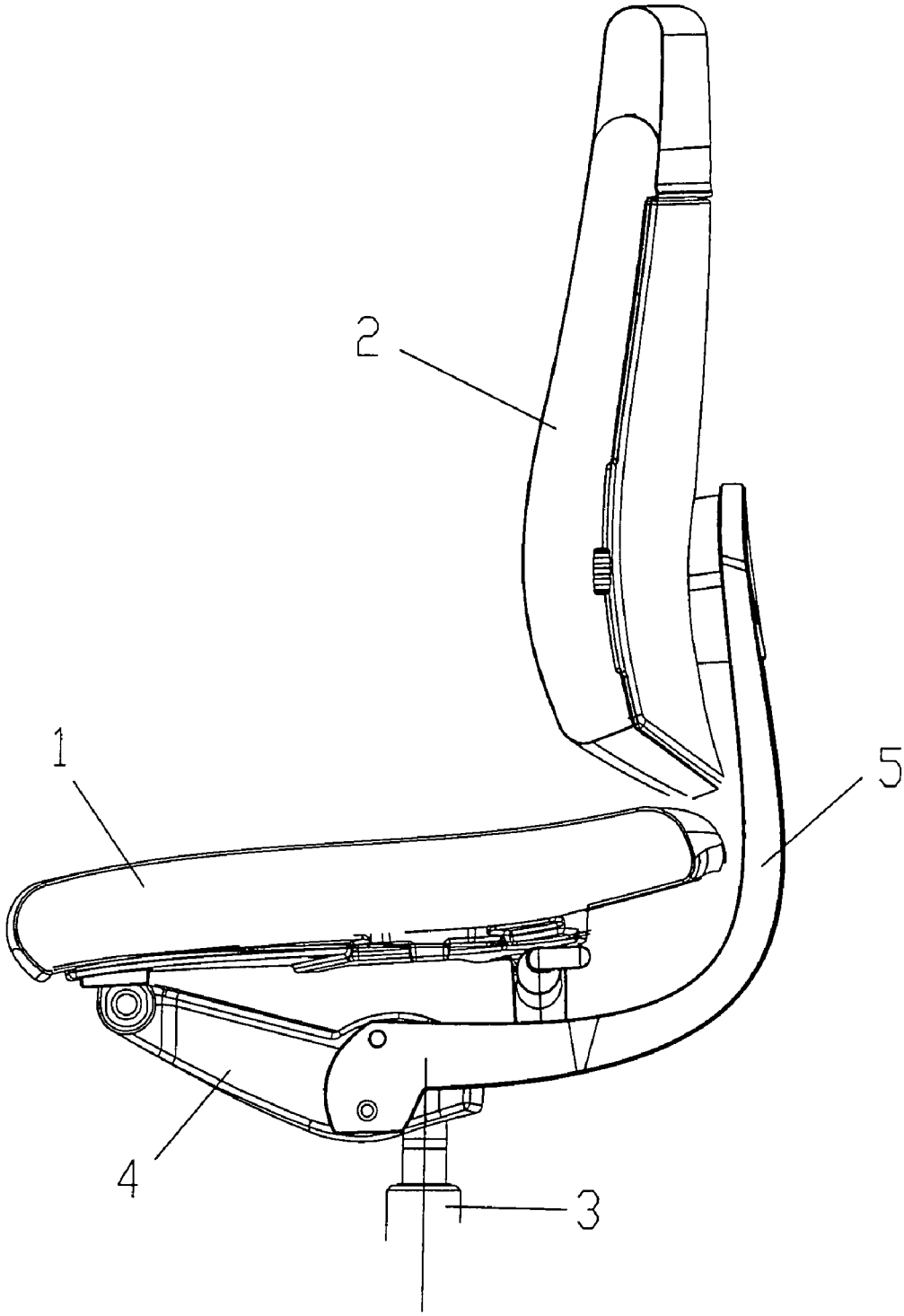
FIG. 2 is a side view as shown in FIG. 1, but with a greatly tilted seat.

The main parts of the chair shown in FIG. 1 and FIG. 2 are a seat 1, a back 2 with back support 5, a tilt mechanism in a housing 4 and a standing column 3. The back support 5 basically consists of two roughly parallel links, of which only the front one is recognizable in FIGS. 1 and 2.

Seat 1 and back support 5 with back 2 are forcibly coupled in regard to tilting in familiar fashion through the tilt mechanism in the housing 4 and the linked connection of the seat 1 to the back support 5. When the back 2, and with it the back support 5, is tilted backward, the seat is also lowered.

Figure 3:
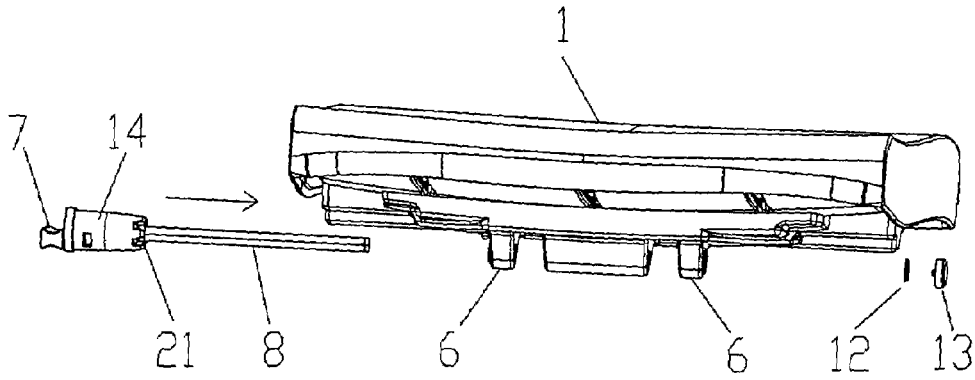
FIG. 3 is a rear view of the chair and, separately depicted, the parts forming the axis of the eccentric bearing, according to the invention.
Figure 4:
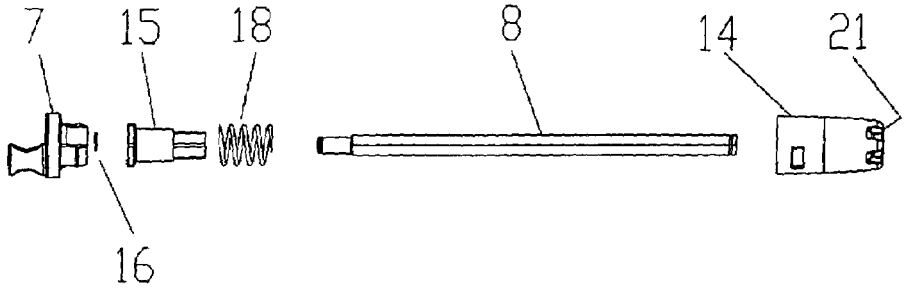
FIG. 4 is an exploded view of the parts shown in FIG. 3.
Figure 5:
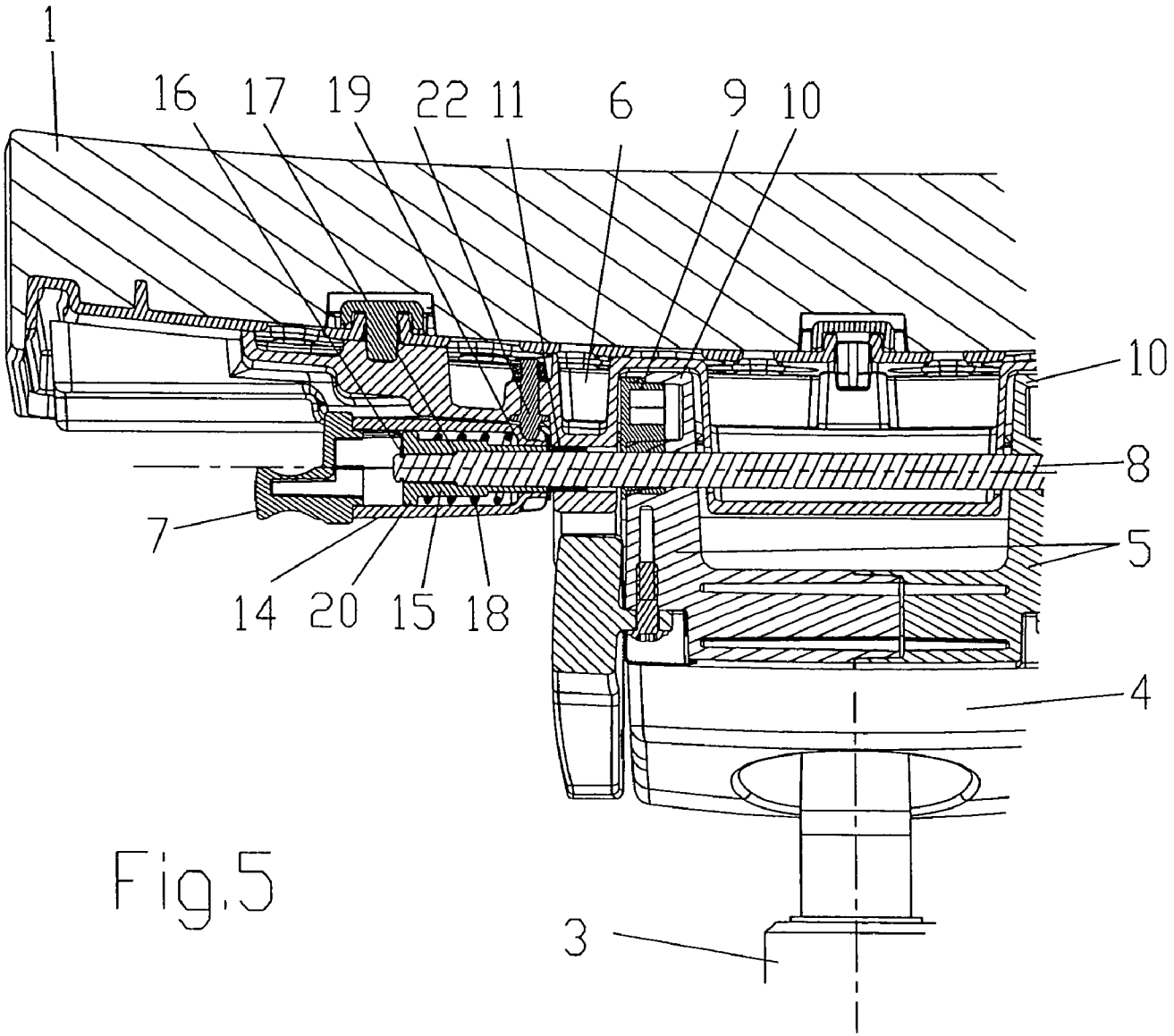
FIG. 5 is a partial sectional view of an eccentric bearing of the invention.

The linked connection of the seat to the back support 5 in its rear region comprises the elements 6-22, which are shown in detail in FIGS. 3-5. Insofar as the terms "left" or "right" are used hereafter, they refer to the representation in FIGS. 3-5.

Two arms 6 are formed at the bottom side of the seat 1, serving to mount a rod 8, which for the major portion of its length is configured as a hexagon (or also with a different prismatic shape). The rod 8 is inserted through bearing eyes in the arms 6, each time bearing sleeves 11 filling in its hexagonal shape on the outside to form a round cross section. The direction of insertion of the rod 8 is indicated by an arrow. In the inserted state, the rod 8 is secured by a securing ring 12 in the direction of insertion on the other side of the right arm 6. A cap 13 covers the end of the rod 8 and the securing ring 12.

In the area of its left end, before the left arm 6 in the insertion direction, the rod 8 is provided with a detent sleeve 14 and a guide sleeve 15. The guide sleeve 15 is arranged directly on the rod 8 in the detent sleeve 14 and extends along an end region of the rod 8, in which it has a round cross section, and also along a region of the rod 8 with the aforementioned hexagonal cross section. Because of the hexagonal cross section, the guide sleeve 15 is joined to the rod 8 and cannot rotate. Guide sleeve 15 is also defined on rod 8 in the lengthwise direction, namely, by a securing ring 16 on one side and by an end stop 17 on the other side, resulting from the change in cross section between round and hexagonal shapes.

The detent sleeve 14 is also supported by its right end segment against the guide sleeve 15, where both the outer cross section of the guide sleeve 15 and the inner cross section of the detent sleeve 14 are hexagonal, so that the detent sleeve 14 is joined to the guide sleeve 15, and by this also to the rod 8 without the ability to rotate.

From the aforementioned end segment, the detent sleeve 14 extends to the left, at first overlapping the guide sleeve 15 with a spacing, to beyond the left end of the rod 8. A compression spring 18 is arranged between the detent sleeve 14 and the guide sleeve 15, which thrusts to the right against a shoulder 19 of the detent sleeve 14 and to the left against a molded lug 20 on the guide sleeve 15. The molded lug 20 is in contact with the inner wall of the detent sleeve 14. Thanks to this configuration, the detent sleeve 14 can be moved a bit to the left on the rod 8 from its position shown in FIG. 5 against the action of the compression spring 18, sliding on the guide sleeve 15 and being led through this.

At its left free end, the detent sleeve 14 terminates in a handle 7, which is inserted into it and locked in it without the ability to turn. In this way, the rod 8 can be turned by the handle 7.

Two bearing blocks 10 are at the top side of the two links of the back support 5, in each of which an eccentric cam 9 is mounted and can turn. The eccentric cams 9 are eccentrically pierced by the rod 8, which is joined to them without the ability to rotate.

The nonrotating connection of the rod 8 to the eccentric cams 9 is achieved in turn by the configuring of the rod 8 and the openings through which it passes in the eccentric cams 9 as hexagons.

As is especially evident from FIG. 1 and FIG. 2, by turning the handle 7 one can move the passage of the rod 8 through the bearing blocks 10 downward (FIG. 1) or upward (FIG. 2). In this way, the tilting of the seat 1 becomes more flat (FIG. 1) or more steep (FIG. 2), while the tilting of the back 2 stays the same.

At a position of the rod 8 in bearing block 10 in an upper position (e.g., per FIG. 2), the weight of the user would rotate the eccentric cams 9 into the lowest position (e.g., per FIG. 1), if no countermeasures were provided.

These countermeasures, according to the invention, comprise a locking mechanism. For this, the detent sleeve 14 is provided with detent apparatus that interact with mating detent apparatus on the seat 1. In the chosen example, the detent apparatus have the shape of several notches or detent teeth 21 distributed about the circumference on the right end surface of the detent sleeve 14. The mating detent apparatus comprise a locking cog 22, arranged on the underside of the seat and projecting downward, which engages between the detent teeth 21 of the detent sleeve 14 when it is located in the position shown in FIG. 5 and defines this as well as the rod 8 and, through the latter, the eccentric cams 9 in a certain position of rotation.

The position of rotation can be changed if the detent sleeve 14 is pulled out by the handle 7 to the left against the action of the compression spring 18 into a position in which the locking cog 22 is disengaged from the detent teeth 21. When the handle is released, the compression spring 18 brings the detent sleeve 18 back into engagement with the locking cog 22, possibly after a change in its position of rotation.

Since the guide sleeve 15 and compression spring 18 are arranged in the detent sleeve 14, these parts are not visible. Neither is the locking cog 22 visible from normal viewing height. The end of the rod 8 is covered by the cap 13, so that the eccentric mounting as a whole gives an aesthetically pleasing impression.

What has been described above are preferred aspects of the present invention. It is of course not possible to describe every conceivable combination of components or methodologies for purposes of describing the present invention, but one of ordinary skill in the art will recognize that many further combinations and permutations of the present invention are possible. Accordingly, the present invention is intended to embrace all such alterations, combinations, modifications, and variations that fall within the spirit and scope of the appended claims.

I claim:

1. A chair comprising a tilting seat and a back support for carrying a back piece, wherein said chair further comprising a bearing block, a rotatable eccentric cam, a handle and a rod passing eccentrically through the eccentric cam, said rod being connected to said eccentric cam without the ability to rotate relative to said eccentric cam, and being connected at one end to said handle for turning said rod, and wherein an arm is provided in which the rod is mounted such that said rod can be turned, wherein the bearing block is provided on the back support and the arm is provided on the bottom side of the seat;

said chair further comprising a detent sleeve joined to said one end of the rod, said detent sleeve being unable to rotate relative to said rod, but able to slide along the rod between a first and a second position, a first detent apparatus and a second mating detent apparatus, wherein said detent sleeve in the first position engages with said second mating detent apparatus on the seat by said first detent apparatus fashioned on said detent sleeve;

in the second position, the first detent apparatus on the detent sleeve is disengaged from the second mating detent apparatus on the seat and spring-loaded against the first position; and the handle is joined to the detent sleeve without being able to rotate relative to said detent sleeve.

2. The chair according to claim 1, wherein said first detent apparatus is selected from the group consisting of at least one notch and at least one detent tooth provided on said detent sleeve at the end surface.

3. The chair according to claim 2, wherein said first detent apparatus is selected from the group consisting of a plurality of notches and a plurality of detent teeth provided on said detent sleeve at the end surface.

4. The chair according to claim 1, wherein said second mating detent apparatus comprise a locking cog projecting downward from the underside of the seat.

5. The chair according to claim 1, further comprising a compression spring for spring-loading of the detent sleeve, thrusting at one end toward the first position against the detent sleeve and at the other end at least indirectly against the rod.

6. The chair according to claim 5, further comprising a guide sleeve secured on the rod, wherein said guide sleeve is not able to turn or slide, and wherein the compression spring thrusts against said guide sleeve.

7. The chair according to claim 6, wherein said detent sleeve overlaps the compression spring, the guide sleeve and the free end of the rod.

8. The chair according to claim 7, wherein said handle is joined to the detent sleeve on the other side of the free end of the rod.

* * * * *